US005628174A

United States Patent [19]

Mack et al.

[11] Patent Number: 5,628,174

[45] Date of Patent: May 13, 1997

[54] BOBBIN-CHANGING APPARATUS

[75] Inventors: Karl-Heinz Mack, Weilheim; Hermann Güttler, Uhingen, both of Germany

[73] Assignee: Zinser Textilmaschinen GmbH, Ebersbach/Fils, Germany

[21] Appl. No.: 574,267

[22] Filed: Dec. 18, 1995

[30] Foreign Application Priority Data

Dec. 21, 1994 [DE] Germany ..... 44 45 809.6

[51] Int. Cl.[6] ..... D01H 9/10; D01H 9/14

[52] U.S. Cl. ..... 57/281; 57/90; 57/266; 57/274; 242/35.5 A

[58] Field of Search ..... 57/274, 266, 281, 57/90; 242/35.5 A

[56] References Cited

U.S. PATENT DOCUMENTS

| | | | |
|---|---|---|---|
| 5,033,623 | 7/1991 | Grecksch et al. | 242/35.5 A |
| 5,119,621 | 6/1992 | Inger | 57/281 |
| 5,337,551 | 8/1994 | Gresksch et al. | 57/90 |

FOREIGN PATENT DOCUMENTS

| | | | |
|---|---|---|---|
| 0306450 | 8/1988 | European Pat. Off. . | |
| 3445040 | 6/1986 | Germany | 242/35.5 A |
| 4207050 | 9/1993 | Germany | 57/281 |
| 4313024 | 10/1994 | Germany . | |
| 58-41919 | 3/1983 | Japan . | |
| 60-181330 | 9/1985 | Japan . | |
| 62-62933 | 3/1987 | Japan . | |

*Primary Examiner*—William Stryjewski
*Attorney, Agent, or Firm*—Herbert Dubno; Andrew Wilford

[57] ABSTRACT

A bobbin changer is used in combination with a first textile machine having a first conveyor extending along an endless first path moving full bobbins or empty sleeves into the first machine and full bobbins or empty sleeves out of the first textile machine, a second textile machine having a second conveyor extending along an endless second path extending at a location adjacent the first path and moving full bobbins into the second textile machine and empty bobbins out of the second textile machine, and a third textile machine having a third conveyor extending along an endless third path extending at the location adjacent the first and second paths and moving full bobbins out of the third textile machine and empty sleeves into the third textile machine. The bobbin-changing apparatus has an axle centered on and pivotal about an upright axis at the location, a horizontal beam mounted on the axis and having a pair of opposite ends spaced equidistantly from the axis, respective holders on the beam ends adapted to hold and carry full bobbins and empty sleeves, and a drive for rotating the beam about the axis and thereby moving the holders through an orbit. The paths intersect the orbit at respective points.

16 Claims, 6 Drawing Sheets

BOBBIN-CHANGING APPARATUS

FIELD OF THE INVENTION

The present invention relates to a bobbin-changing system. More particularly this invention concerns a system for switching full bobbin cores with empty sleeves or bobbins.

BACKGROUND OF THE INVENTION

In a spinning operation it is necessary to replace full bobbins or sleeves or cores on which roving has been wound with empty sleeves or cores that can be reintroduced into the spinning machine or fly frame for winding roving thereon. The full bobbins are transported away for further treatment which invariably separates the roving from the sleeves that are then returned for reuse. This operation takes place in a highly automated high-speed environment and is invariably carried out by an automatic machine.

Japanese patent documents 58-41919, 60-181330, and 62-62933 describe conveyors that move two parallel rows of staggered full bobbins, each comprising a sleeve carrying a mass of wound yarn or roving, to a transfer location where a complex two-arm unloader removes the full bobbins two at a time and passes them on to another machine, for instance a spinning machine. The arms can also pick up empty sleeves and fit them to the empty hangers of the conveyor so that they can be fed back to the respective machines, for instance roving machines, for winding of a mass of yarn or roving on them. Such a bobbin changer is a fairly complex piece of equipment that operates in a complex manner. It is expensive to build and maintain.

European 0,306,450 of Kogiso describes a conveyor for roving bobbins in a spinning plant which switches full bobbins traveling in two rows past a transfer location with two rows of empty spools passing on the other side of the transfer location. Since each incoming row is associated with a respective outgoing row, the exchange is fairly simple.

Furthermore German 4,313,024 of Kroll describes a bobbin changer that receives full bobbins in two parallel rows and that hands them off to another conveyor. This device is extremely complex, having holders that pivot on arms mounted on a beam pivotal itself about an axis between the input and output rows.

OBJECTS OF THE INVENTION

It is therefore an object of the present invention to provide an improved bobbin changer.

Another object is the provision of such an improved bobbin changer which overcomes the above-given disadvantages, that is which is relatively simple and that can switch bobbins and empty sleeves between two input conveyors and a single output conveyor.

SUMMARY OF THE INVENTION

The instant invention is used in combination with a first textile machine having a first conveyor extending along an endless first path moving full bobbins or empty sleeves into the first machine and full bobbins or empty sleeves out of the first textile machine, a second textile machine having a second conveyor extending along an endless second path extending at a location adjacent the first path and moving full bobbins into the second textile machine and empty bobbins out of the second textile machine, and a third textile machine having a third conveyor extending along an endless third path extending at the location adjacent the first and second paths and moving full bobbins out of the third textile machine and empty sleeves into the third textile machine. The invention is a bobbin-changing apparatus having an axle centered on and pivotal about an upright axis at the location, a horizontal beam mounted on the axis and having a pair of opposite ends spaced equidistantly from the axis, respective holders on the beam ends adapted to hold and carry full bobbins and empty sleeves, and a drive for rotating the beam about the axis and thereby moving the holders through an orbit. The paths intersect the orbit at respective points.

This arrangement is therefore quite simple. The beam need merely be positioned so that its holders are at the intersection points to pick up and pass off full bobbins and empty sleeves. It can easily be adapted to all sorts of different configurations.

In accordance with this invention the first and second machines are spinning machines and the third machine is a roving machine. The first and second paths pass through the orbit to one side of the axis and the third path passes through the orbit to the other side of the axis. Thus each of the points of the third machine is diametrally opposite relative to the axis to a respective point of the first and second machines. Thus at the same time a full bobbin can be grasped at one end of the beam while an empty sleeve is picked up at the opposite end or vice versa. After pivoting through 180°, the exchange can be completed. The bobbin changer further has means for raising and lowering the holders at the points for picking up and releasing full bobbins and empty sleeves from the conveyors.

Several different layouts are possible. At least one of the first and second paths can be tangent to the orbit while the other of the first and second paths passes secantially through the orbit. The first and second paths can both pass secantially through the orbit. Only one of the first and second paths can be tangent to the orbit while the other passes secantially through it or only one of the first and second paths can pass secantially through the orbit. It is also possible for the third path to have a section extending arcuately along and on the orbit, or even for the first and second paths to cross where they intersect the orbit. This orientation makes an exchange very simple.

The apparatus according to this invention can have a controller for operating the raising and lowering drive and respective sensors at the points for supplying information to the control means. The sensors can include sensors at the points for supplying information to the controller about the position of the beam. Further sensors can be provided at the points for supplying information to the control means about the respective conveyors. The controller can operate the conveyors also.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
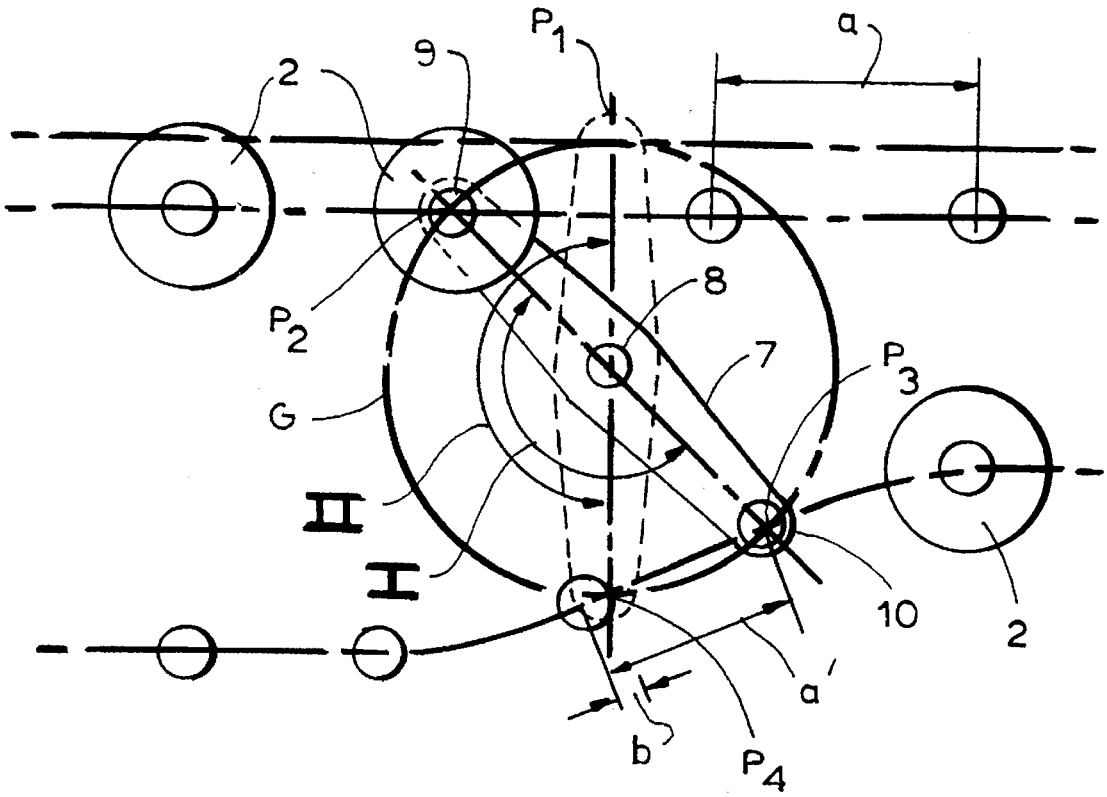
FIGS. 1, 2, and 3 are small-scale top views illustrating apparatuses according to the invention.
Figure 7:
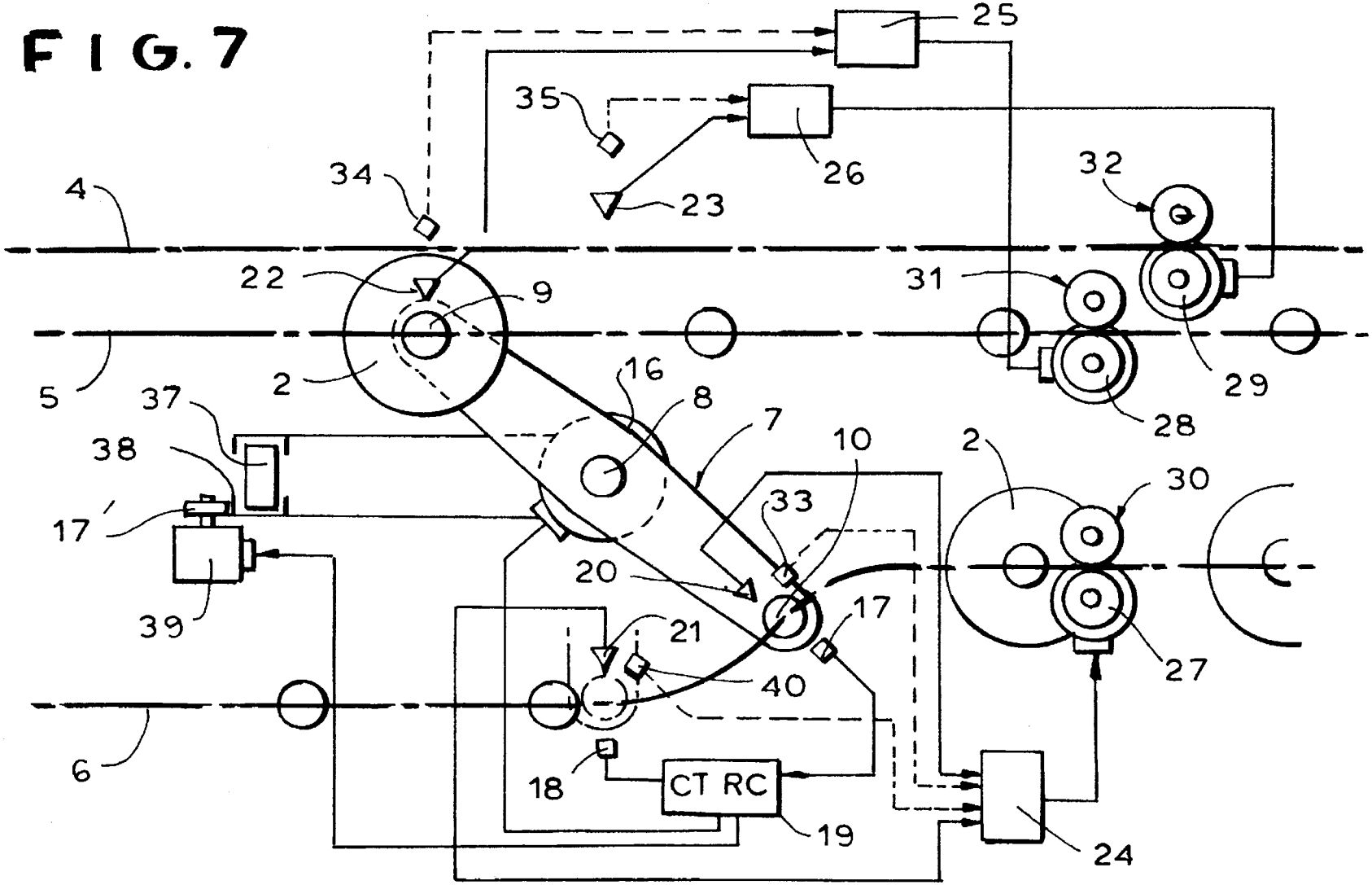
FIG. 7 is a largely schematic top view of the FIG. 1 apparatus.
Figure 8:
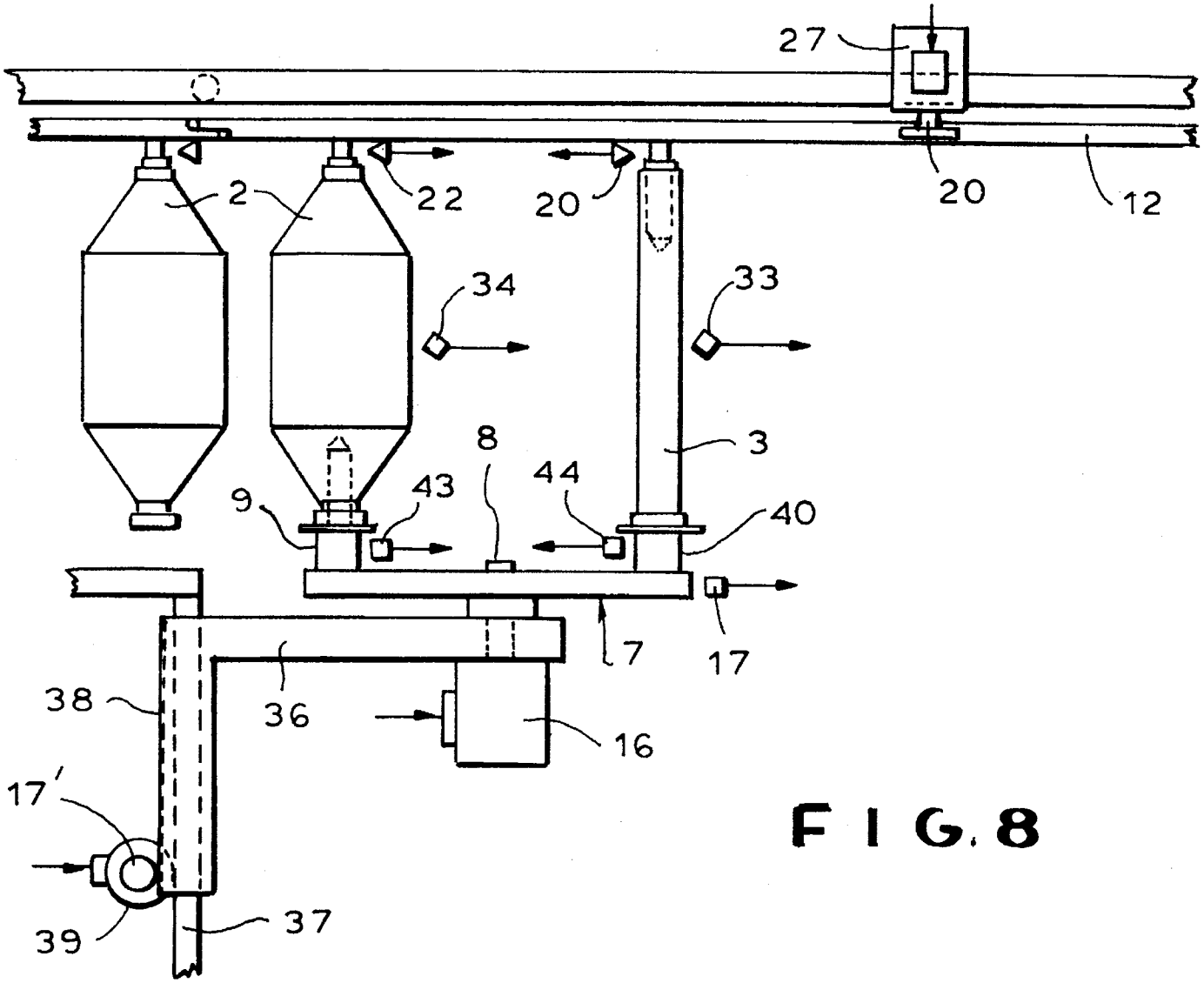
FIG. 8 is a side view of the apparatus of FIG. 7.
Figure 9:
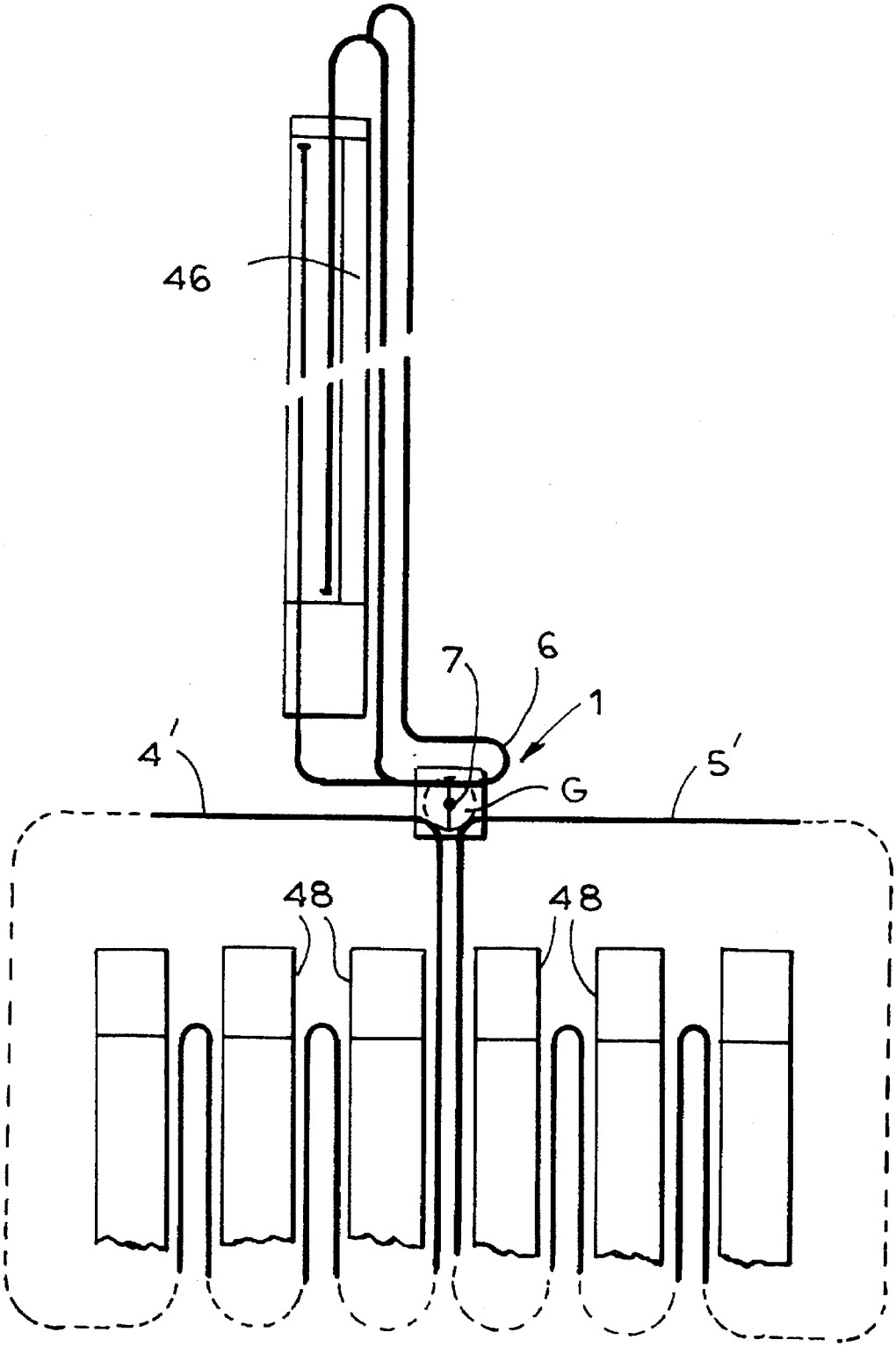
FIG. 9 is a small-scale top view of a system embodying the bobbin changer according to the invention.

As seen in FIGS. 1, 7, and 8 a bobbin-changer 1 according to this invention switches full bobbins 2 with empty sleeves or cores 3, it being understood that each full bobbin 2 comprises a sleeve 3 on which is wound a mass of yarn or roving. FIG. 9 shows how a roving machine 46 has a conveyor or track 6' which passes through the machine while ring-spinning machines 48 have conveyors or tracks 4' and 5' that similarly pass through the machine. The tracks 4', 5' have sections that run along paths 4 and 5 that pass through the machine parallel to each other and the track 6' has a section running along a path 6 that passes through the machine offset from and not parallel thereto.

The changing apparatus 1 comprises a horizontal straight changing beam 7 pivoted centrally at an upright axle 8 and having at its end spindle-type holders 9 and 10 equispaced from the axle 8 so that on rotation of the beam 7 they describe a circular orbit G. This orbit G intersects the paths 4 and 5 at points $P_1$ and $P_2$ and the path 6 at two points $P_3$ and $P_4$. Points $P_1$ and $P_4$ are diametrically opposite each other relative to the axis 8 as are points $P_2$ and $P_3$. The bobbins 2 and cores 3 are spaced apart in the paths 4 and 5 by distances a equal to the distance through which they are advanced with each step of the respective conveyor and the bobbins 2 and cores 3 are spaced apart in the path 6 by a smaller distance a' or a yet smaller step distance (a'–b) as described below.

In FIGS. 7 and 8 the axle 8 and a motor 16 that can pivot the beam 7 are mounted on an outrigger arm 36 formed at least in part by a tubular rack 38 riding on a guide bar 37 and engaged by a pinion 17' of a motor 39 that serves to raise and lower the two holders 9 and 10 at the ends of the beam 7. Carriages 12 running along the paths 4, 5, and 6 are engaged by respective wheels 29, 28, and 27 driven by respective motors 32, 31, and 30. Respective control units 24, 25, and 26 operate the motors 27, 28, and 29 in accordance with position outputs produced by sensors 20, 21, 22, and 23 for the positions $P_1$ through $P_4$ to stop the conveyors running along the paths 4, 5, and 6 when the bobbins 2 or sleeves 3 carried thereby are in the various positions. Further sensors 17 and 18 are connected to a controller 19 and serve to detect when the beam 8 is in either of its two positions, one with its holders 9 and 10 in the positions $P_2$ and $P_3$ and the other with its holders 9 and 10 in the positions $P_1$ and $P_4$. This controller 19 is connected to the motor 16 to stop it when the beam 7 reaches the desired position. It is to be understood that the two controllers 19 and 24 are only operated by one of the respective two sensors 17, 18; 20, 21 that is itself actuated. Similarly only that one of the controllers 25 or 26 is operated that corresponds to the path 4 or 5 being serviced. Further sensors 33, 34, 35, and 40 are provided for detecting if a bobbin 2 or sleeve 3 is in the respective position $P_1$, $P_2$, $P_3$, or $P_4$. If the position is empty, the respective drive 30, 31, or 32 is operated to advance the needed bobbin 2 or sleeve 3 into position.

In addition further sensors 43 and 44 are provided to ascertain the vertical positions of the holders 9 and 10 which are spring loaded to be limitedly vertically displaceable on the beam 7. When the sensor 43 or 44 detects that the respective holder 9 or 10 is being pushed down, it sends a signal to the controller 19 to stop the motor 39 and prevent further lifting of the beam 7.

Figure 6:
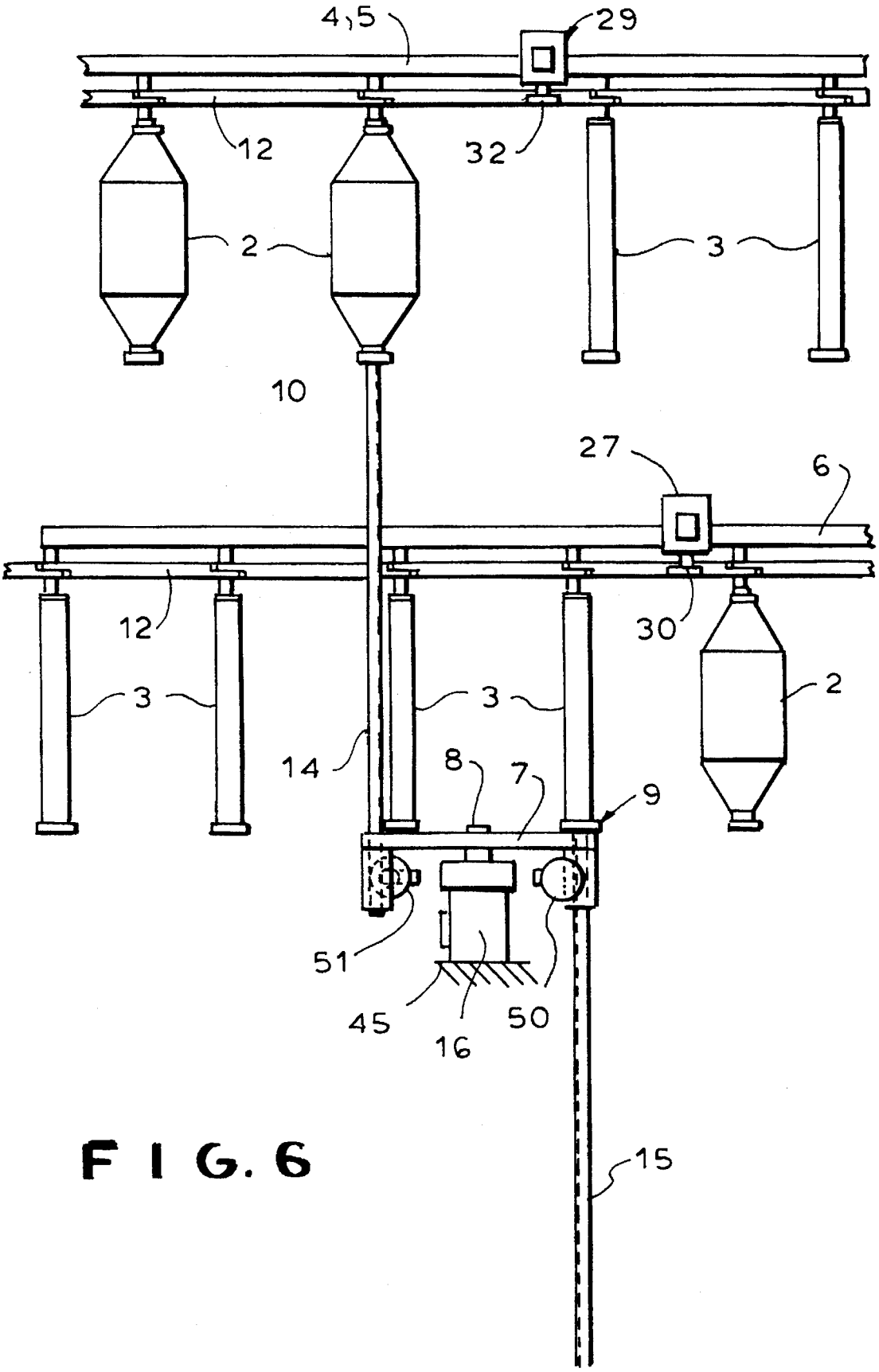
FIG. 6 is a side view of a variant of the apparatus of the invention.

FIG. 6 shows how the holders 9 and 10 can be formed as spindles carried on racks 14 and 15 so they can be raised and lowered by motors 50 and 51 carried on the beam 7. Here the motor 16 is fixed to a frame 45 of the machine 1 and serves to rotate the beam 7 about its upright axis and the track defining the path 6 is below the tracks defining the paths 4 and 5.

To exchange between paths 5 and 6 the beam 7 is positioned as shown in solid lines in FIG. 1 and the holder 9 is raised into the bobbin 2 at the point $P_2$ while the holder 10 is raised into the empty core sleeve 3 at the point $P_3$. Then the two holders 9 and 10 are dropped to a lower level and the beam 7 is rotated by the motor 16 as indicated by double-headed arrow I through 180° to position the holder 10 with its empty sleeve 3 under the point $P_2$ and the holder 9 with its bobbin 2 under the point $P_3$ and the two holders 9 and 10 are raised to snap the respective cores and bobbins into place on the grabs of the respective tracks 5 and 6. Then the track 5 is advanced through a step a and the track 6 through a step a' so the cycle can be repeated.

To exchange between paths 4 and 6 the beam 7 is positioned as shown in dashed lines in FIG. 1 and the holder 9 is raised into the bobbin 2 at the point $P_1$ while the holder 10 is raised into the empty core sleeve 3 at the point $P_4$. Then the two holders 9 and 10 are dropped to a lower level and the beam 7 is rotated as indicated by double-headed arrow II through 180° to position the holder 10 with its empty sleeve 3 under the point $P_1$ and the holder 9 with its bobbin 2 under the point $P_4$ and the two holders 9 and 10 are raised to snap the respective cores and bobbins into place on the grabs of the respective tracks 4 and 6. Then the track 4 is advanced through a step a and the track 6 through a step (a'–b) so the cycle can be repeated.

Figure 2:
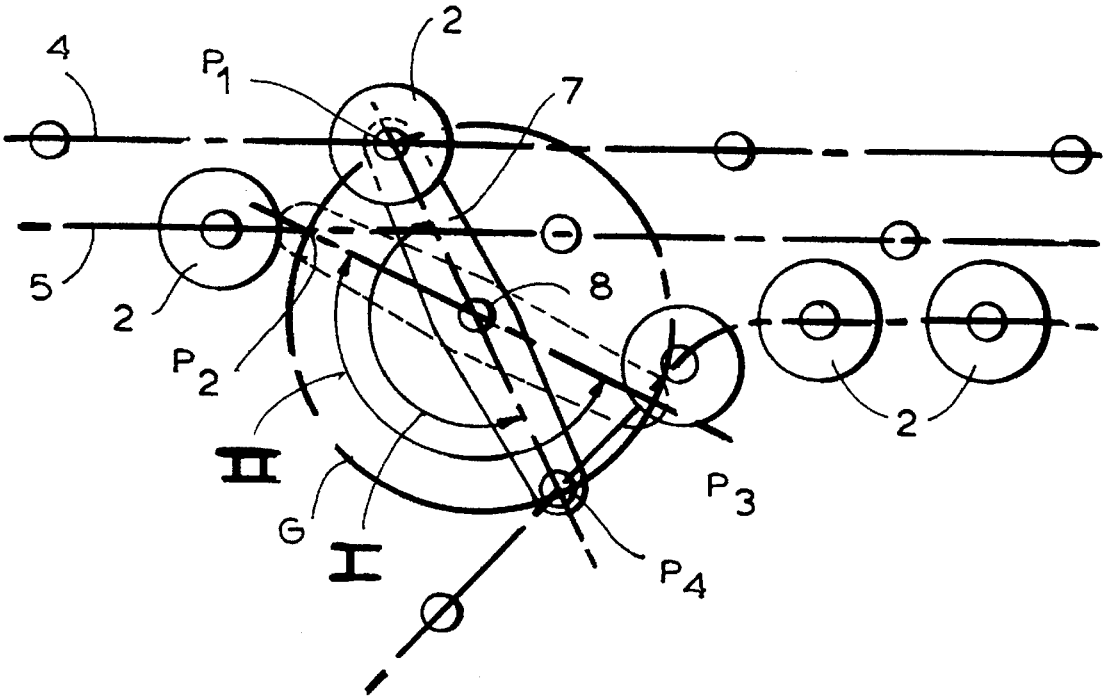

While in FIG. 1 the path 4 tangents the orbit G, in FIG. 2 the path 4 extends as a secant through the orbit G, intersecting it at two locations. Otherwise this arrangement works like that of FIG. 1.

Figure 3:
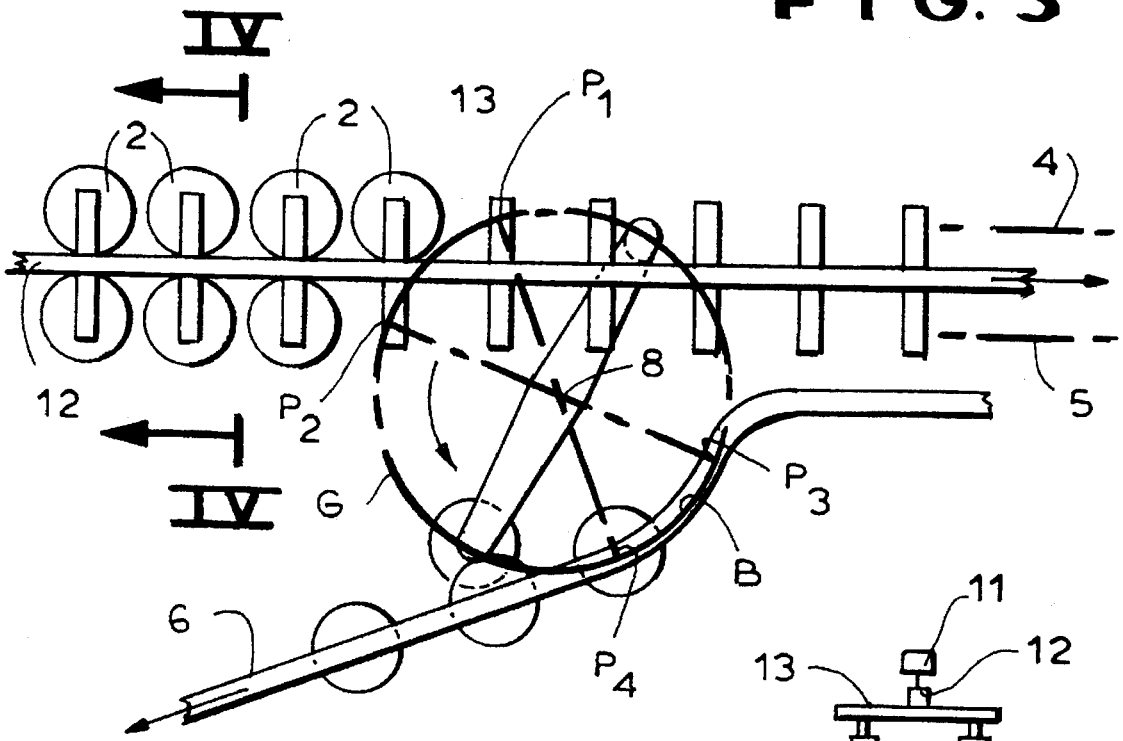
Figure 4:
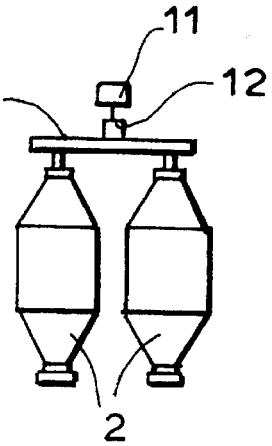
FIG. 4 is a section taken along line IV—IV of FIG. 3

FIGS. 3 and 4 show an arrangement where the path 6 has a section B that is curved to coincide with a section of the orbit G. In addition the two paths 4 and 5 are defined by a central track 11 from which hangs the carriages 12 supporting crosspieces 13 each capable of carrying two bobbins 2. The circularly arcuate section B makes it easy to adapt this system to different spacings between the paths 4 and 5 and/or between the bobbins 2.

Figure 5:
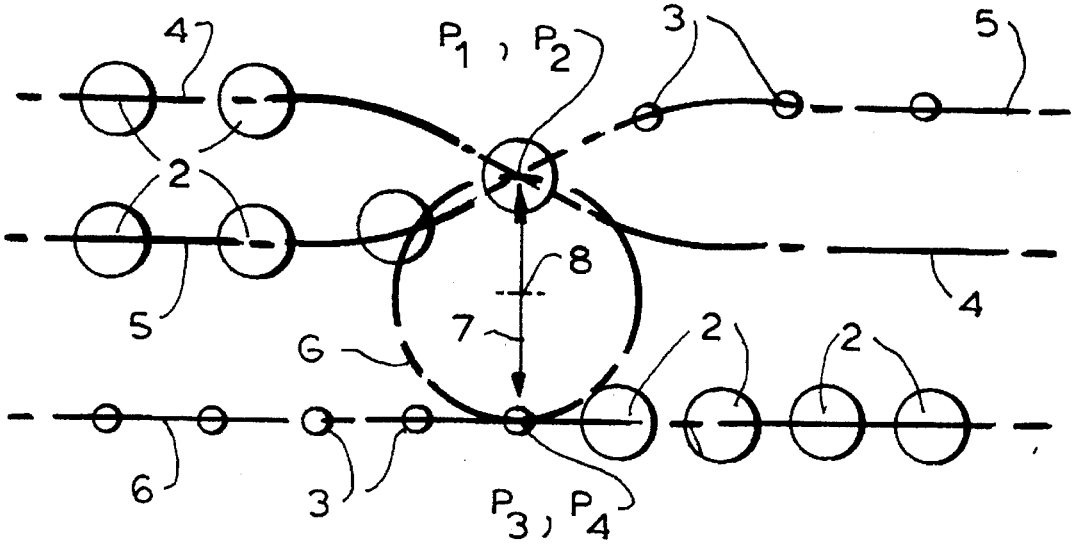
FIG. 5 is a top view of another apparatus according to the invention.

In FIG. 5 the two paths 4 and 5 cross so that the points $P_1$ and $P_2$ coincide, as do the points $P_3$ and $P_4$. The orbit G here tangents the two transfer points $P_1$, $P_2$; $P_3$, $P_4$.

We claim:

1. A bobbin and empty sleeve transfer system for a textile machine installation, said system comprising:

at least one endless conveyor forming separate first and second endless paths each extending on one side of a given location past said location and provided with moving trains of downwardly hanging full bobbins and empty sleeves for displacing said trains past said location;

a third endless conveyor forming a third endless path on an opposite side of said given location and provided with a moving train of downwardly hanging full bobbins and empty sleeves for displacing said train of said third endless conveyor past said given location;

an axle centered on and pivotal about an upright axis at said given location;

a horizontal beam mounted on said axle and having a pair of beam ends diametrically opposite one another and spaced equidistantly from said axis;

respective holders on the beam ends adapted to hold and to carry full bobbins and empty sleeves; and means for rotating said beam about said axis and thereby moving said holders through an orbit intersected by said paths at a first transfer point individual to said first path, at a second transfer point individual to said second path and at third and fourth transfer points individual to said third path, said first and third transfer points and said second and fourth transfer points being respectively diametrically opposite one another across said axis, whereby said holders of said beam are simultaneously engageable with full bobbins and empty sleeves at said first and third points and are simultaneously engageable with full bobbins and empty sleeves at said second and fourth points in two angularly offset positions of said beam about said axis to effect bobbin exchange of said first and second paths with said third path.

2. The bobbin and empty-sleeve transfer system defined in claim 1, further comprising means for raising and lowering the holders at the points for picking up and releasing full bobbins and empty sleeves from the conveyors.

3. The bobbin and empty-sleeve transfer system defined in claim 1 wherein at least one of the first and second paths is tangent to the orbit while the other of the first and second paths passes secantially through the orbit.

4. The bobbin and empty-sleeve transfer system defined in claim 1 wherein the first and second paths pass secantially through the orbit.

5. The bobbin and empty-sleeve transfer system defined in claim 1 wherein only one of the first and second paths is tangent to the orbit.

6. The bobbin and empty-sleeve transfer system defined in claim 1 wherein only one of the first and second paths passes secantially through the orbit.

7. The bobbin and empty-sleeve transfer system defined in claim 1, further comprising:

means for raising and lowering the holders at the points for picking up and releasing full bobbins and empty sleeves from the conveyors;

control means for operating the raising and lowering means; and respective sensors at the points for supplying information to the control means.

8. The bobbin and empty-sleeve transfer system defined in claim 7 wherein the sensors include sensors at the points for supplying information to the control means about the position of the beam.

9. The bobbin and empty-sleeve transfer system defined in claim 8 wherein the sensors includes sensors at the points for supplying information to the control means about the respective conveyors.

10. The bobbin and empty-sleeve transfer system defined in claim 9 wherein the control means is connected to the conveyors for stepping the conveyors past said location.

11. The bobbin and empty-sleeve transfer system defined in claim 1 wherein the first and second paths are generally parallel to each other at the location.

12. The bobbin and empty-sleeve transfer system defined in claim 1 wherein each of the holders is an upright spindle fittable into a lower end of the empty sleeves and full bobbins.

13. The bobbin and empty-sleeve transfer system defined in claim 1 wherein each of the conveyors has a row of hangers from which the respective empty sleeves and full bobbins hang.

14. The bobbin and empty sleeve transfer system defined in claim 1 wherein said first and second points coincide and said third and fourth points coincide.

15. A bobbin and empty sleeve transfer system for a textile machine installation, said system comprising:

at least one endless conveyor forming separate first and second endless paths each extending on one side of a given location past said location and provided with moving trains of downwardly hanging full bobbins and empty sleeves for displacing said trains past said location;

a third endless conveyor forming a third endless path on an opposite side of said given location and provided with a moving train of downwardly hanging full bobbins and empty sleeves for displacing said train of said third endless conveyor past said given location;

an axle centered on and pivotal about an upright axis at said given location;

a horizontal beam mounted on said axle and having a pair of beam ends diametrically opposite one another and spaced equidistantly from said axis;

respective holders on the beam ends adapted to hold and to carry full bobbins and empty sleeves; and means for rotating said beam about said axis and thereby moving said holders through an orbit intersected by said paths at a first transfer point individual to said first path, at a second transfer point individual to said second path and at third and fourth transfer points individual to said third path, said first and third transfer points and said second and fourth transfer points being respectively diametrically opposite one another across said axis, whereby said holders of said beam are simultaneously engageable with full bobbins and empty sleeves at said first and third points and are simultaneously engageable with full bobbins and empty sleeves at said second and fourth points in two angularly offset positions of said beam about said axis to effect bobbin exchange of said first and second paths with said third path, the third path having a section extending arcuately along and on the orbit and provided with said third and fourth points.

16. A bobbin and empty sleeve transfer system for a textile machine installation, said system comprising:

at least one endless conveyor forming separate first and second endless paths each extending on one side of a given location past said location and provided with moving trains of downwardly hanging full bobbins and empty sleeves for displacing said trains past said location;

a third endless conveyor forming a third endless path on an opposite side of said given location and provided with a moving train of downwardly hanging full bobbins and empty sleeves for displacing said train of said third endless conveyor past said given location;

an axle centered on and pivotal about an upright axis at said given location;

a horizontal beam mounted on said axle and having a pair of beam ends diametrically opposite one another and spaced equidistantly from said axis;

respective holders on the beam ends adapted to hold and to carry full bobbins and empty sleeves; and means for rotating said beam about said axis and thereby moving said holders through an orbit intersected by said paths at a first transfer point individual to said first path, at a second transfer point individual to said second path and at third and fourth transfer points individual to said third path, said first and third transfer points and said second and fourth transfer points being respectively diametrically opposite one another across said axis, whereby said holders of said beam are simultaneously engageable with full bobbins and empty sleeves at said first and third points and are simultaneously engageable with full bobbins and empty sleeves at said second and fourth points in two angularly offset positions of said beam about said axis to effect bobbin exchange of said first and second paths with said third path, the first and second paths corresponding where they intersect said orbit.

* * * * *